United States Patent [19]

Gasser

[11] Patent Number: 4,840,343

[45] Date of Patent: Jun. 20, 1989

[54] QUICK RELEASE SEAT SUPPORT

[76] Inventor: George E. Gasser, 4136 Loganway, Youngstown, Ohio 44505

[21] Appl. No.: 163,744

[22] Filed: Mar. 3, 1988

[51] Int. Cl.[4] ..... A47B 97/00

[52] U.S. Cl. ..... 248/500; 297/174

[58] Field of Search ..... 248/500, 503.1; 297/135, 138, 217, 427, 440, 174; 108/50; 312/235 R, 140.4; 244/118.6; 296/65 R, 63, 64

[56] References Cited

U.S. PATENT DOCUMENTS

| | | | |
|---|---|---|---|
| 697,182 | 4/1902 | Steckenreiter | 297/217 X |
| 1,049,159 | 12/1912 | Simmel | 297/174 X |
| 1,254,969 | 1/1918 | Blayney | 312/235 R |
| 1,339,491 | 5/1920 | Axberg | 248/222.2 X |
| 1,513,907 | 11/1924 | Hugo | 297/174 |
| 2,098,655 | 11/1937 | De Lisle | 297/174 |
| 2,489,543 | 11/1949 | Sanford | 248/222.2 X |
| 3,214,030 | 10/1965 | Graham | 248/222.2 X |
| 3,350,151 | 10/1967 | Phillips | 312/235 R |
| 4,085,867 | 4/1978 | Heller | 248/222.2 X |
| 4,367,819 | 1/1983 | Lewis | 248/222.2 X |

FOREIGN PATENT DOCUMENTS

| | | | |
|---|---|---|---|
| 864036 | 3/1961 | United Kingdom | 248/222.2 |

*Primary Examiner*—J. Franklin Foss

*Attorney, Agent, or Firm*—Harpman & Harpman

[57] ABSTRACT

A seat support that provides for rapid and simple removal of the seat support and attached seat from a fixed location. The seat support is removably secured to a desired location and is characterized by a one-piece flat extension having an upstanding seat engageable post at one end and a curved upturned registerable form on the free end.

3 Claims, 1 Drawing Sheet

QUICK RELEASE SEAT SUPPORT

BACKGROUND OF THE INVENTION

1. Technical Field

This device relates to chair and seat supports that provide an upstanding single post to support a fixed or rotatable seat thereon. In certain environments a seat is required to be affixed to its point of use and yet be easily removable for cleaning and/or repair of the mechanisms to which it is attached.

2. Description of Prior Art

Prior Art devices of this type have relied on a variety of different support configurations to space and secure a seat in relation to a special location, such as a service counter. See for example U.S. Pat. Nos. 317,254, 877,837, 1,254,969 and 3,350,151.

In U.S. Pat. No. 317,254 a stool for tables is disclosed having a vertically adjustable stool pivotally attached to a post depending from the underside of a table.

U.S. Pat. No. 877,837 discloses a sewing machine attachment wherein a hair on rollers can be moved towards and away from a sewing machine on a pair of spaced parallel elongated tracks.

U.S. Pat. No. 1,254,969 discloses a reading table having a chair supported by an arm extending to the table and adjustably secured thereto. The chair can be moved towards and away from the table.

Finally, in U.S. Pat. No. 3,350,151 a counter structure is disclosed having an arcuate counter portion with a plurality of spaced attached stools secured thereto. Each stool has a pair of leg extensions that extend to and are permanently secured to the counter.

SUMMARY OF THE INVENTION

A removable seat support to temporarily secure and attach a seat to a fixed location. The device allows for quick and easy removal of the seat so as to be repositioned to another location or resecured to its original location. The device is of a onepiece support member having an upstanding seat engageable on a post and a quick release configuration on the free end for registerable attachment with the point to which it is secured.

DESCRIPTION OF THE PREFERRED EMBODIMENT

Figure 1:
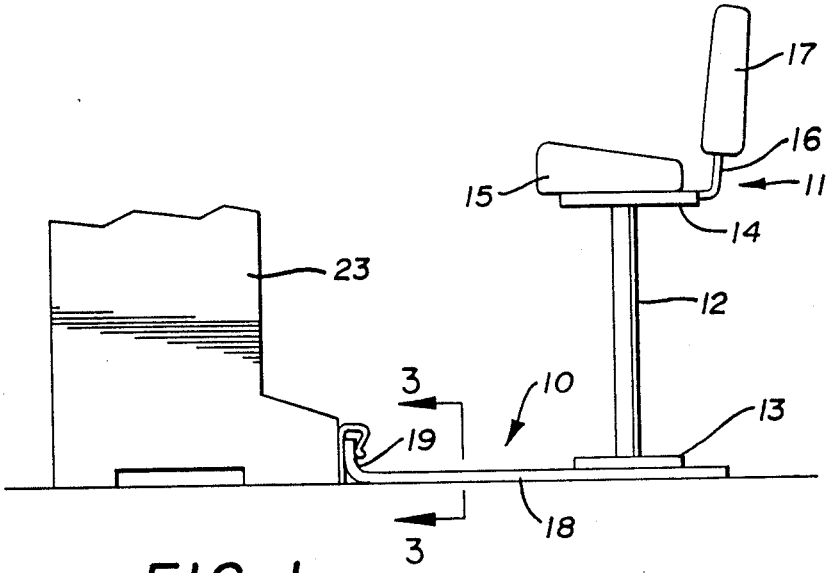
FIG. 1 is a side plan view of the device in use.

A quick release seat support 10 has a seat configuration 11 secured thereto comprising a post 12 having a support base 13. A seat frame 14 is mounted to the free end of said post 12 with a seat cushion 15 positioned thereon. A back support 16 is formed from an upstanding portion of the seat frame 14 and has a back cushion 17 secured thereto facing said seat cushion 15 as will be well known and understood by those skilled in the art. The quick release seat support 10 comprises an elongated generally flat body member 18 having the support base 13 secured inwardly of one end and a curved upstanding quick release fitting 19 on the oppositely disposed end thereof.

Figure 3:
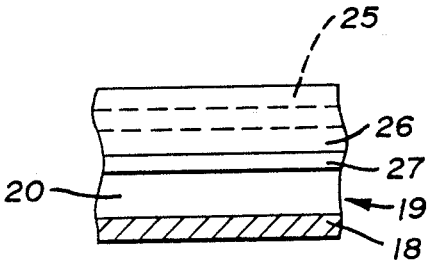
FIG. 3 is a section on lines 3—3 of FIG. 1.
Figure 4:
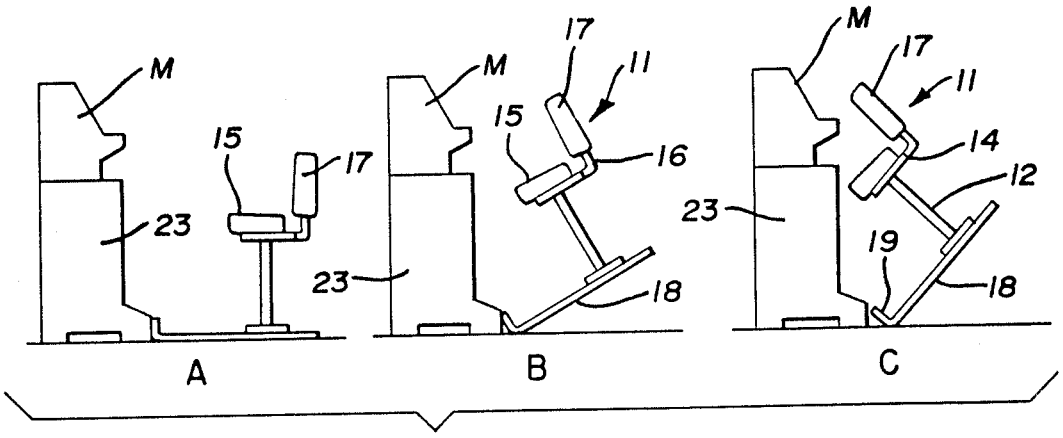
FIG. 4 is a multiple composite view illustrating the required chair positions to disengage and remove the device from the secured position.

Referring now to FIGS. 3 and 4 of the drawings the quick release fitting 19 can be seen in greater detail comprising a compound curve 20 with a foreshortened vertically aligned registration portion 21 extending therefrom. The inverted generally u-shaped channel member 22 is secured to a machine base 23 and comprises in cross-section a vertically ascending engagement leg 24 having a right angularly extending flange portion 25 with a down-turned angularly inclined descending portion 26. An out-turned guide flange 27 is formed on the end of said descending portion 26 defining an inward facing convex resilient engagement surface at 28. The overall cross-sectional shape of said channel member 22 defines an area of reduced transverse dimension between said engagement leg 24 and said engagement surface 28.

In operation the machine base 23 has a machine M secured or integral with said machine base 23. The quick release seat support 10 and its attached seat configuration 11 are secured thereto as best seen in solid lines in FIGS. 1, 2 and 4 of the drawings. To remove the quick release seat support 10, the seat configuration 11 is lifted vertically as illustrated in FIG. 4B and in broken lines B in FIG. 2. As the base 18 moves upwardly with the seat configuration 11, the registration portion 21 of the quick release fitting 19 moves downwardly within the u-shaped channel member 22 flexing the descending portion 26 of the channel.

Figure 2:
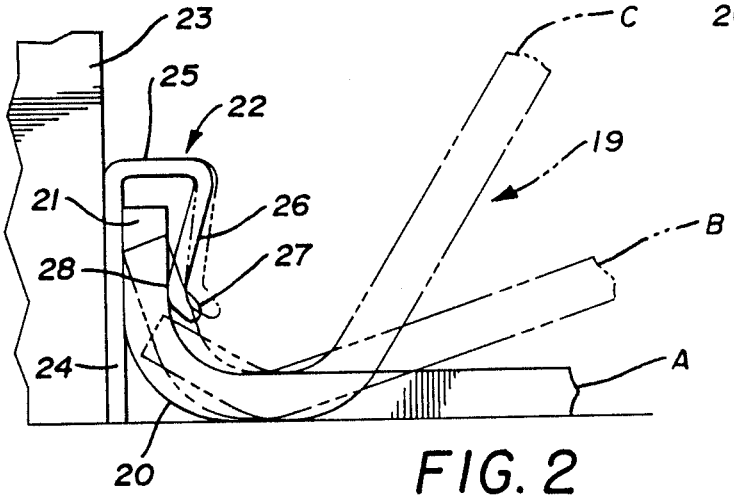
FIG. 2 is an enlarged broken away portion of the point of attachment of the device.

Referring now to FIGS. 2 and 4C of the drawings the chair configuration 11 is fully raised allowing for clearance of the registration portion 21 within the u-shaped channel 22 and removal of the quick release seat support 10. The descending portion 26 returns to its original shape.

For reinsertion of the quick release seat support 10 the above described steps are reversed whereby the seat configuration 11 is raised as seen in FIG. 4C and the quick release fitting 19 is engaged within the u-shaped channel member 22 deflecting the descending portion 26 as in FIGS. 2 and 4B with the final registration and alignment following as seen in FIGS. 2 and 4A.

It will be evident that installed in environments that require periodic access to the machine base 23, such as casinos and the like, the ease of removal of the quick release seat support 10 is of a very desirous nature reducing machine down time and associated profits.

Thus, it will be seen that a new and useful quick release seat support has been illustrated and described and that various changes and modifications may be made therein without departing from the spirit of the invention, therefore I claim:

I claim:

1. A quick release seat support comprising in combination an elongated flat body member, a seat configuration secured to said elongated flat body member, a quick release fitting on said elongated body member comprising a curved portion of said elongated body member having a forshortened free upstanding end thereon at right angles to the plane of said elongated body member, said free upstanding end having parallel planar surfaces, an inverted fixed elongated channel member having an angularly inclined descending portion aligned for compound angular registration of said curved portion of said body member engaging and resiliently displacing the angularly inclined descending portion within, said elongated channel member secured to a machine base.

2. The quick release seat support of claim 1 wherein said seat configuration comprises a seat frame support on a post extending from said elongated body member in spaced relation to said quick release fitting.

3. The quick release seat support of claim 1 wherein said angularly inclined descending portion of said elongated channel member has a out-turned guide flange having an oppositely disposed engagement surface, registrable with said forshortened free upstanding end of said curved portion.

* * * * *